United States Patent [19]

Tutas et al.

[11] Patent Number: 4,818,329

[45] Date of Patent: Apr. 4, 1989

[54] APPARATUS FOR DISPENSING AND APPLYING TAPE

[75] Inventors: Edward P. Tutas, Kenosha; Donald J. Passehl, Waterford, both of Wis.

[73] Assignee: Kranz Incorporated, Racine, Wis.

[21] Appl. No.: 165,818

[22] Filed: Mar. 9, 1988

[51] Int. Cl.[4] ..... B32B 35/00

[52] U.S. Cl. ..... 156/391; 156/527; 156/577; 156/579

[58] Field of Search ..... 156/391, 523, 527, 574, 156/577, 579

[56] References Cited

U.S. PATENT DOCUMENTS

| | | | |
|---|---|---|---|
| 1,901,908 | 3/1933 | Hoyos | 156/577 |
| 2,280,460 | 4/1942 | Voigt et al. | 156/391 |
| 3,537,941 | 11/1970 | Miklos | 156/577 |
| 3,709,760 | 1/1973 | Knoner | 156/527 |
| 4,336,097 | 6/1982 | Van Kampen et al. | 156/579 |

*Primary Examiner*—Michael Wityshyn

*Attorney, Agent, or Firm*—James E. Nilles; Thomas F. Kirby

[57] ABSTRACT

A manually operable tape dispenser/applicator device is provided for applying pressure sensitive adhesive masking tape to a portion of the surface of an automobile body fascia which comprises a plurality of parallel grooves. The device comprises a rigid support frame on which are mounted: a manual grip or handle for pulling the device along a path; a spindle for rotatably supporting a roll of tape; a rotatable resilient pressure roll around which tape from the roll is reeved and which presses the tape against the grooved portion of the surface to be masked; a spring-biased adjustably movable plate for holding the tape against the pressure roll and to prevent backlash when the tape is cut; a tape cut-off blade; a spring-biased movable blade guard; a guide member including a plurality of (four) spaced-apart groove-engaging projections engageable with certain grooves for guiding the device and tape dispensed therefrom along a path parallel to the grooves; and a guide adjustment mechanism for adjustably positioning the guide member and the projections relative to the lateral edges of the tape.

13 Claims, 3 Drawing Sheets

APPARATUS FOR DISPENSING AND APPLYING TAPE

BACKGROUND OF THE INVENTION

1. Field of Use

This invention relates generally to apparatus for dispensing and applying adhesive tape to an object.

In particular, it relates to improved guide means for guiding the apparatus along the surface of an object to which masking tape is applied to ensure precise location of the masking tape.

2. Description of the Prior Art

In the automotive industry, conventional metal front and rear automobile bumpers are rapidly being replaced by molded plastic resilient "bumpers", called "fascia", which are of complex design and configuration and have functional and decorative surfaces integrally formed therein. A typical fascia for the front end of an automobile body has an elongated outer front surface which extends across the front of the auto body and integrally formed short side surfaces at the opposite ends of the outer front surface which extend rearwardly for a short distance along opposite sides of the auto body. The outer front surface is generally straight but in some designs the center of the outer front surface includes an apex which projects or bulges forwardly slightly. A typical facia for the rear end of an auto body is similarly configured but is reversely disposed on the rear end of the auto body. Furthermore, some fascia include a plurality of parallel decorative grooves which extend along the outer surface and curve around the short side surfaces. If, for aesthetic reasons, the fascia is to be spray-painted but the grooved decoration is not, it is necessary to apply pressure sensitive adhesive masking tape over the grooved decoration prior to painting. It is imperative that the tape be precisely and exactly located to assure an acceptable paint job. Presently, the masking tape is applied manually by a human operator who tears three strips of tape from a roll and applies one strip along the center of the grooved decoration and another overlapping strip at each end surface thereof. This procedure is time-consuming, labor-intensive, unduly costly, wasteful of tape, and sometimes results in misalignment of the side edges of two overlapping strips of tape thereby causing an unsightly paint job.

It is desirable, therefore, to overcome the aforesaid drawbacks by providing improved apparatus for dispensing and applying masking tape to the grooved portion of fascia of the aforedescribed character.

Various types of prior art manually operable devices and tools for dispensing and applying adhesive tape, such as sealing tape for sealing cartons and masking tape for objects to be painted, are known and/or in use. However, insofar as applicants are presently aware, no prior art devices and tools are ideally suited for the purpose above-described.

Prior art type dispenser/applicators (hereinafter called "applicators") typically comprise a support frame on which are mounted a handle to manually pull the applicator along a surface to be taped, means to rotatably support a roll of tape, a pressure roll around which the tape is reeved, and a tape cut-off blade. Some prior art applicators further comprise some sort of guide means on the support frame or elsewhere which engages the object and guides the applicator as it is moved so as to ensure that the tape is applied along a specific path.

The following patents show the state of the art and certain specific prior art features.

U.S. Pat. No. 4,103,472 shows a manual taping device having a guide roller 34 and which is operable to apply tape to seal a circular cover on a drum-like container.

U.S. Pat. No. 4,357,198 shows a manual tape applicator having an edge guide 28, 32 and which is operable to apply one or two parallel spaced apart strips of tape.

British Patent No. 869,555 shows a tape application tool having a preforming roll 10 and a guide.

U.S. Pat. No. 3,935,758 shows a tape application tool in which a flange or disc 44 on the tape applicator roll 24 itself serves as a guide.

U.S. Pat. No. 2,280,460 shows a device for applying tape over a joint between two insulating batts and which has a single thin beveled shank portion 31 which rides in the joint between the batts to serve as a guide.

U.S. Pat. No. 2,576,622 shows a tape applicator having an edge guide flange 48.

U.S. Pat. No. Re. 31,726 shows an applicator for adhesive labels.

SUMMARY OF THE PRESENT INVENTION

In accordance with the present invention there is provided improved apparatus in the form of a manually operable tape dispenser/applicator device for applying masking tape to a portion of a surface of an object, which portion comprises, or is bounded by, or is defined by at least one groove or by a plurality of parallel grooves.

The improved device is especially well-adapted for applying pressure sensitive adhesive masking tape to the multi-grooved portion of a surface of an object, such as an automobile body fascia, but could have other utility.

The improved device generally comprises a rigid support frame comprising two laterally spaced apart frame side plates and a frame base plate on which are mounted: a manual grip or handle on the frame base plate for pulling the device along a path; means on one frame side plate for rotatably supporting a roll of tape; a pressure applying member, such as a pressure roll, between the two frame side plates around which tape from the roll is reeved and which presses the tape against a surface to be masked; spring-biased adjustably movable means between the two frame side plates for holding the tape against the pressure roll and to prevent backlash of the tape when cut; tape cut-off means including a blade; spring-biased movable blade guard means between the two frame side plates for the tape cut-off blade; guide means, including a guide member or locator base connected to the underside of the frame base plate and having a plurality of spaced-apart groove-engaging projections thereon, for guiding the device along a path; and guide adjustment means on the guide member and frame base plate for adjustably positioning the guide member and the projections thereon relative to the lateral edges of the tape.

In the preferred embodiment for use with an object having parallel grooves, the guide member has a pair of downwardly extending longitudinally spaced apart forward and rear projections along one lateral side of the guide member and a similar pair of forward and rear projections along the other lateral side of the guide member. Furthermore, the guide member is preferably formed with an upwardly extending convex curve to afford clearance so that the device is not obstructed as it moves along the path when used on a surface portion which includes an apex.

In operation, the device is placed on the surface of the object to be masked so that one pair of guide projection engages one of the grooves and the other pair engages another parallel groove. This ensures that the pressure roll and tape therearound is properly positioned relative to the portion of the surface to be masked and causes the adhesive side of the tape beneath the pressure roll to adhesively engage the surface. The device is then pulled by the user along the path and tape is stripped from the roll of tape (which rotates) and pressed against the portion of the surface to be masked. When a desired length of tape has been applied, the user stops moving the device along the path and rotates or tilts the device upwardly so that, first, both of the forward projections are lifted from the grooves and then, second, both of the rear projections are lifted from the grooves. As this occurs, the blade guard, which has been engaging and tracking along the upper side of the tape being applied, pivots out of the way and allows the bottom rear corners of the two frame side plates to engage the surface and serve as pivot points enabling further tilting movement of the device until the tape engages the tape cut-off blade. Then, the user pulls the device upward to cut the tape, whereupon the blade guard is spring-biased back to its maximum protective position and the device is ready for the next taping operation. The spring-biased means for holding the tape against the pressure roll prevents tape backlash off of the tape roll as cutting occurs, but can be manually repositioned temporarily clear of the pressure roll to allow the user to provide a new roll of tape and reeve the tape around the pressure roll when the need arises.

A tape dispensing and application device in accordance with the present invention offers many advantages over the prior art. For example, the guide member, by using forward and rear groove-engaging projections, affords longitudinal stability and ensures that the pressure roll (and tape therearound) has proper vertical spacing relative to the surface portion to be taped. The use of two pairs of such projections, each pair comprising a forward and a rear projection, affords lateral stability and ensures that the pressure roll (and tape therearound) is properly positioned relative to the surface portion to be taped, i.e., the axis of the pressure roll is generally parallel and transverse to the surface. Such stability is not found in the aforementioned prior art devices, and especially not in U.S. Pat. No. 2,280,460. The length of the projections relative to grooves of a predetermined depth and the curvature of the guide plate selected enable the device to be used on grooved surface portions which are substantially flat or straight, as well as those which include a pronounced apex.

The means for holding the tape against the pressure roll provides for maximum control of the tape as it is dispensed and as it is cut, but can be easily moved out of the way while the tape is being threaded in the device.

The blade guard means offers maximum protection against injury to the user of the device prior to, during and after tape application but is automatically movable out of the way during a tape cutting operation and is also further movable manually to a position clear of the cutting blade to enable the blade to be easily replaced when necessary.

The components of the device are constructed and arranged so that the center of gravity of the device is substantially directly above the pressure roll so that the weight of the device itself provides the pressure needed to effect adhesion of the tape to the surface and so that the need of tiresome operator-applied pressure is reduced or eliminated.

The device enables precise application of tape, is easy and not fatiguing to use, is reliable, fool-proof and safe to use and service.

Other objects and advantages of the invention will hereafter appear.

DRAWINGS

DESCRIPTION OF THE PREFERRED EMBODIMENT

Figure 1:
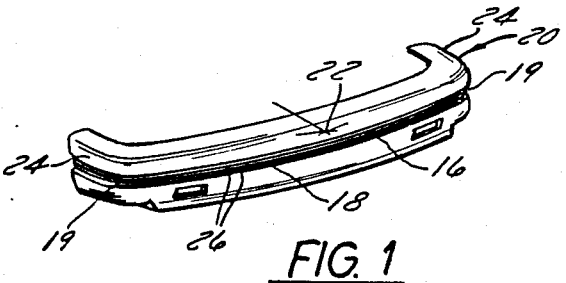
FIG. 1 is a perspective view of the front of an automobile body bumper or fascia of a type with which a tape dispenser/applicator device in accordance with the invention is advantageously employed.
Figure 2:
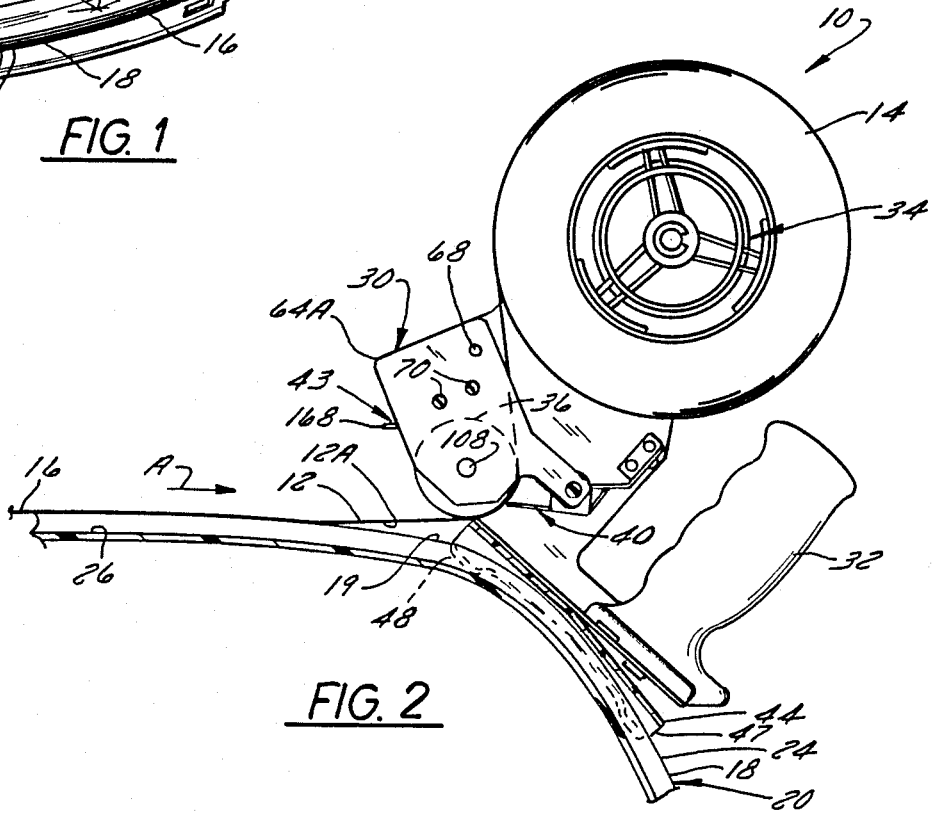
FIG. 2 is a side elevation view of a tape dispenser/applicator device in accordance with the invention showing it in association with the fascia of FIG. 1 and disposed in the tape application mode.

FIG. 2 shows a dispenser/applicator device 10 in accordance with the invention which, as FIG. 2 shows, is manually movable in the direction of arrow A for applying pressure sensitive adhesive masking tape 12 from a roll of tape 14 to a multi-grooved surface portion 16 of an outer surface 18 of an object, such as a molded plastic automobile body facia 20 shown in FIGS. 1 and 2. Tape 12 has a layer of pressure sensitive adhesive 12A (FIG. 2) on one surface. Device 10 has front and rear ends, respectively, which correspond to the right and left ends, respectively, in FIG. 2.

Figure 4:
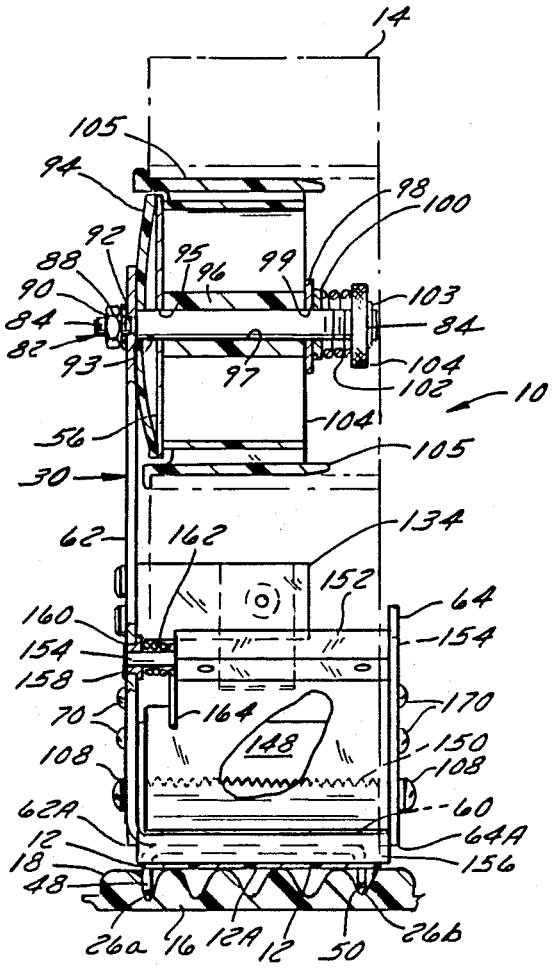
FIG. 4 is an end elevation view of the rear end of the device showing it in association with the fascia and disposed in the tape application mode.
Figure 7:
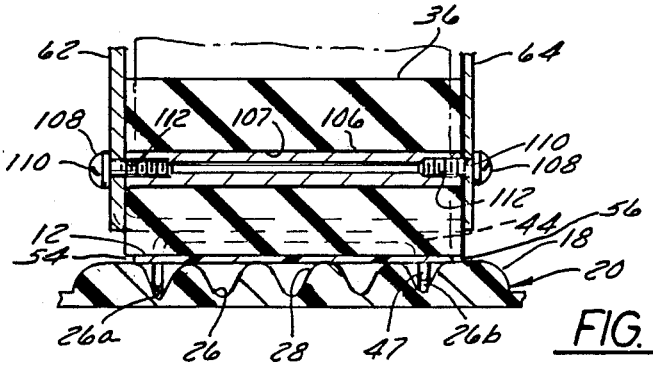
FIG. 7 is an enlarged cross-sectional view of the pressure roll of FIGS. 4 and 5.

FIGS. 1 and 2 show that outer surface 18 of facia 20 projects, slopes or curves forwardly outwardly near its center, as at apex 22 in FIG. 1, and has an integrally formed short side surface, such as 24, at each of its opposite ends which is joined by a sharp curved corner 19 to outer surface 18. FIGS. 1, 4 and 7 show that multi-grooved surface portion 16 comprises a plurality of parallel grooves 26, including outermost grooves **26*a* and 26*b*, and a plurality of parallel ridges 28, each ridge 28 being disposed between and defined by a pair of adjacent grooves 26. As hereafter appears, the two outermost grooves 26*a* and 26*b* serve to guide device 10**.

As FIGS. 2, 3, 4, 8 and 9 show, device 10 generally comprises a rigid support frame 30 on which are mounted: a manual grip or handle 32 for pulling the device along a path in the direction of arrow A (FIG.

2); means 34 for rotatably supporting the roll of tape 14; a pressure roll 36 around which tape 12 from roll 14 is reeved and which presses the tape against grooved surface portion 16 of facia 20; spring-biased adjustably movable means 40 for holding or pressing the tape against pressure roll 36 and to prevent backlash when the tape is cut; tape cut-off means 42; spring-biased movable blade guard means 43 for the tape cut-off means 42; guide means 44, including a plate member or locating base 46 having a plurality (four) of spaced-apart groove-engaging projections 47, 48, 49, 50, for guiding device 10 along the path; and guide adjustment means 52 (FIG. 9) for adjustably positioning the projections 47–50 of guide means 44 relative to the lateral edges 54, 56 (FIG. 7) of the tape 12.

Figure 3:
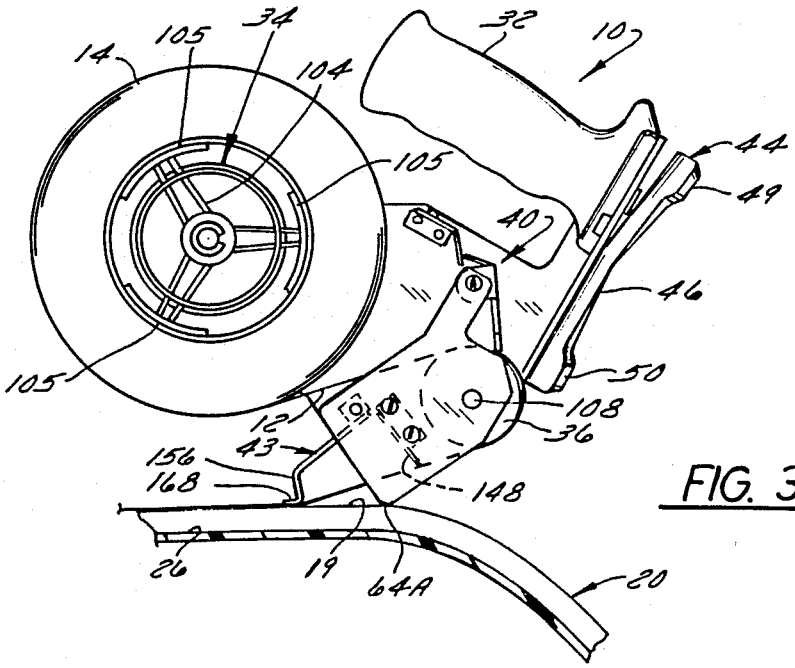
FIG. 3 is a view similar to FIG. 2 but showing the device disposed in the tape cutting mode.
Figure 6:
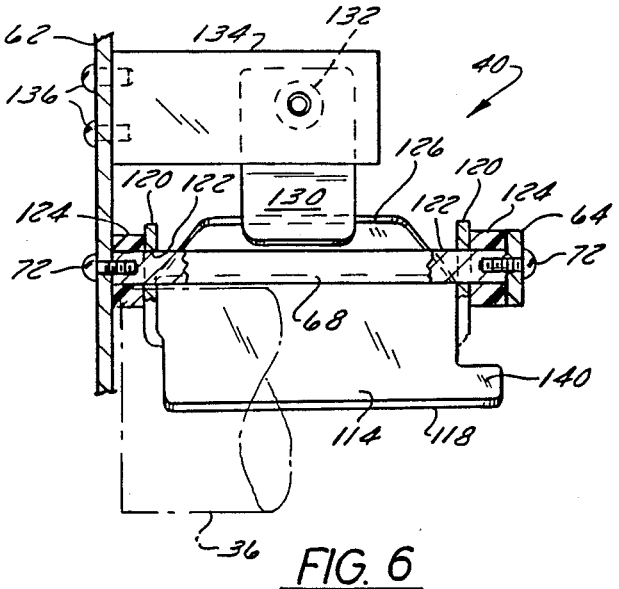
FIG. 6 is a front elevation view, partly in section, of the tape holding means of FIG. 5.

Referring to FIGS. 4, 6, 8 and 9, support frame 30 is fabricated of rigid sheet metal and comprises a frame base plate 60, an upwardly extending integral frame side plate 62, and a frame side plate 64 which is laterally spaced from integral side plate 62 and rigidly supported thereon by means of a support bar 66 and a support rod 68 (FIG. 6). The opposite ends of support bar 66 are connected to the side plates 62 and 64 by four screws 70 which extend through holes (not visible) in the plates and screw into threaded holes (not visible) in the ends of support bar 66. The opposite ends of support rod 68 are connected to the side plates 62 and 64 by two screws 72 which, as FIG. 6 shows, extend through holes in the plates and screw into threaded holes in the ends of support rod 68. As FIGS. 3 and 4 show, the frame side plates 62 and 64 have corners 62A and 64A at the rear end of device 10 which serve as pivot points, as will hereafter appear.

Figure 8:
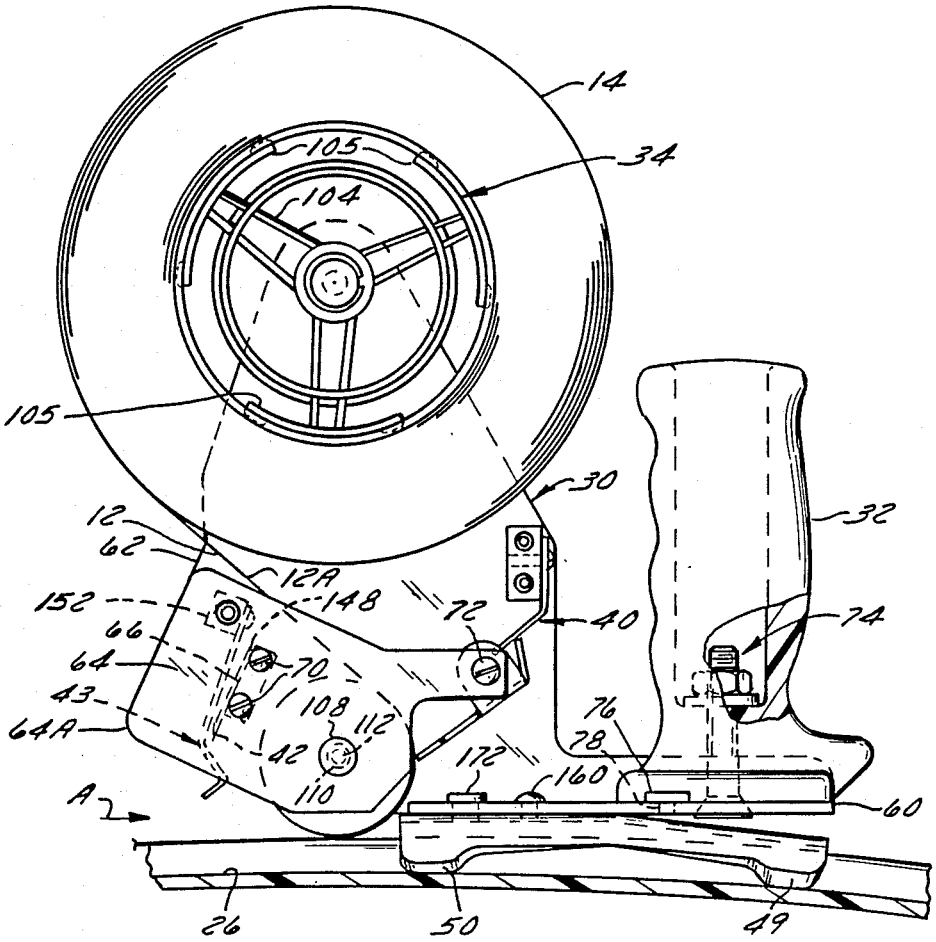
FIG. 8 is an enlarged view of the device, similar to FIG. 2, with certain portions broken away to reveal interior details.

As FIG. 8 shows, the manual grip or handle 32, which is formed of molded plastic, is rigidly secured to the upper side of base plate 60 near the front end thereof by a bolt/nut assembly 74. A locator plate 76 is secured to the upper side of base plate 60 by two screws 78 (one visible in FIG. 8) and engages a groove 80 formed in the underside of handle 32 to aid bolt/nut assembly 74 in transmitting manual pulling force from the handle to support frame 30.

Referring to FIGS. 4 and 8, the means 34 for rotatably supporting the roll of tape 14 on support frame 30 comprise a stationary spindle 82 which has threaded opposite ends 84 and 86. The threaded end 84, which is adjacent a shoulder 93, extends through a hole 88 near the upper end of integral side plate 62 of support frame 30 and is provided with an outer nut 90 and a lock washer 92. When tightened, inner nut 91 draws shoulder 93 against plate 62. Disposed on spindle 82 are: a relatively large circular metal retainer disc 94 having a hole 95 therethrough, a plastic roll supporting spool 96 having a bore 97 therethrough and which abuts disc 94, a relatively small circular metal retainer disc 98 having a hole 99 therethrough and which abuts spool 96, a washer 100, a helical compression spring 102, a large manually adjustable knurled tensioning nut 104 which is threaded onto the threaded end 86 of spindle 82 and a lock washer 103. When nut 104 is tightened and spring 102 is compressed, the amount of force required to effect rotation of spool 96 can be adjusted. Spool 96 has an outside diameter, defined by arcuate segments 105, which is selected to accommodate the bore of the roll of tape 14 which is manually press-fitted onto spool 96. It is to be noted that the means 34 do not have to be disassembled to replace a roll of tape 14 when the roll is exhausted.

Figure 5:
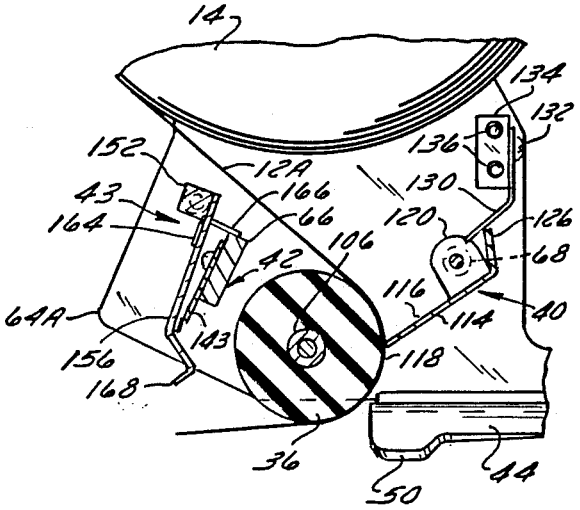
FIG. 5 is a side elevation view, partly in section, of a portion of the device of FIG. 4, including a pressure roll, a tape holding means and a tape cut-off means.

As FIGS. 5 and 7 show, the pressure roll 36 around which tape 12 from roll 14 is reeved takes the form of a hollow cylindrical resiliently compressible roller which is fabricated of rubber, neoprene or the like having a bore 107 in which a shaft or axle 106 is disposed. Pressure roll 36 is rotatable on axle 106 which is secured between the side plates 62 and 64 of support frame 30 by means of two screws 108, each of which extends through a hole 110 in a respective side plate and screws into a threaded hole 112 in a respective end of axle 106. When device 10 is disposed in its normal operating position for tape application (as shown in FIG. 8), the lower surface of roll 36 projects below the frame side plates 62 and 64 so that it can bear against the tape 12 reeved therearound and press the tape against the surface portion 16 to which the tape is to be applied.

As FIGS. 5 and 6 best show, the spring-biased adjustably movable means 40 operates to hold or press tape 12 against pressure roll 36 and also prevents tape backlash when the tape is cut after a desired length of tape has been applied to surface portion 16. The means 40 comprises a rigid plate or member 114, preferably metal, which is pivotally mounted on the aforementioned support rod 68 which is rigidly secured between the side plates 62 and 64 of support frame 30. The member 114 comprises a flat portion 116 having a straight smooth edge 118 which is parallel to the axis and to the surface of pressure roll 36. Flat portion 116 is provided on its opposite lateral sides with two upwardly-extending mounting tabs 120 which adapt member 114 for pivotal mounting on support rod 68. Thus, each mounting tab 120 has a hole 122 for accommodating support rod 68 so that member 114 can pivot on rod 68. Member 114 is properly spaced axially on rod 68 relative to the axis of pressure roll 36 by means of two hollow cylindrical bushings 124 which may be made of metal or plastic. Each bushing 124 is disposed on rod 68 between the outside of a respective mounting tab 120 and a respective frame side plate 62 or 64. The member 114 further comprises an upwardly bent flat portion 126, integral with previously described flat portion 116, which has an edge 128 which is engaged by the underside of the free end of a resilient steel leaf spring 130. The opposite end of spring 130 is rigidly secured by means of a screw 132 to a spring support member 134. Spring support member 134, in turn, is rigidly secured to the inner face of frame side plate 62 by means of two screws 136, each of which extends through a hole (see FIG. 6) in side plate 62 and threads into a threaded hole (see FIG. 6) in the end of spring support member 134. Leaf spring 130 is biased downwardly (with respect to FIGS. 5 and 6) into engagement with edge 128 of member 114 and operates to bias member 114 clockwise (with respect to FIG. 5) so that edge 118 of member 114 bears against tape 12 and forces it against pressure roll 36 when device 10 is ready for operation. However, member 114 has a small finger-engageable tab 140 on one lateral edge of flat portion 116 to enable the use of device 10 to pivot member 114 counterclockwise (with respect to FIG. 5) and clear of pressure roll 36 when tape 14 is to be threaded around pressure roll 36. When member 114 is pivoted counterclockwise for tape threading purposes, its spring-engaging edge 128 forces leaf spring 130 upward and into a position wherein member 114 is releasably jammed in a position clear of pressure roll 36. When tape threading is accomplished, member 114 is manually moved to its normal spring-biased position shown in FIG. 5.

Referring to FIGS. 3, 4, 5 and 8, the tape cut-off means 42 comprises a flat cutting blade 148 which has a downwardly depending serrated, but otherwise straight, tape cutting edge 150. Blade 148 is rigidly secured to the rear side of previously described support bar 66 located between the frame side plates 62 and 64 by means of two screws 151 (only one visible in FIG. 5), each of which extends through a hole (not visible) in blade 148 and screws into a threaded hole (not visible) in support bar 66. The cutting edge 150 is spaced rearwardly from and is parallel in the axial direction to the surface of pressure roller 36. Cutting edge 150 does not extend below the lower edges of frame side plates 62 and 64 and is only engageable with tape 12 to effect cutting thereof when a strip of tape has been applied and the entire device 10 is manually rotated counterclockwise, as shown in FIG. 3, by the user and then pulled forwardly so that the cutting edge 150 engages and cuts the tape.

Referring to FIGS. 2, 3, 4, 5 and 8, the spring-biased movable blade guard means 43 for cutting blade 148 comprises a rotatable shaft 152 having cylindrical opposite ends 154 and to which a downwardly depending blade guard plate 156 is secured. Each end 154 is rotatably supported in a bushing or bearing 158 which is mounted in a hole 160 formed in a respective frame side plate 62 or 64. A helical biasing spring 162 (FIG. 4) is disposed on one end 154 of shaft 152. As FIG. 5 shows, one end 164 of spring 162 bears against the rear side of guard plate 156 and the other end 166 of spring 162 bears against the upper side of support bar 66. Spring 162 operates to bias guard plate 156 counterclockwise (with respect to FIG. 5) against the heads of the blade mounting screws 151. As FIGS. 2, 5 and 8 show, guard plate 156, which never engages the cutting edge 150 of blade 148, has a straight lower edge 168 which projects below the lower edges of the frame side plates 62 and 64 and thus affords good protection against injury when device 10 is not actually applying tape. However, as FIG. 3 shows, when device 10 is disposed in the tape application position shown in FIG. 3, the guard plate 156 is forced in the clockwise direction (with respect to FIG. 3) against spring bias as its lower edge 168 engages the taped surface portion 16. Guard plate 156 can thus pivot clockwise when device 10 is rotated during a tape severing operation. When the tape is severed and device 10 is lifted from the work, the guard plate 156 is again biased counterclockwise to its maximum safe position.

Figure 9:
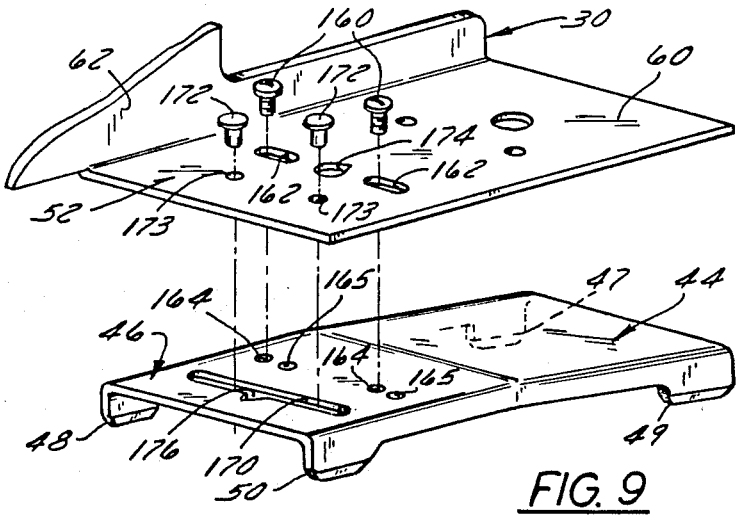
FIG. 9 is an enlarged exploded perspective view of a portion of the support frame and the guide means of the device.

Referring to FIG. 9, the guide means 44 for guiding device 10 along the desired path during tape application comprises a plate member or locating base 46, preferably fabricated of aluminum, which has four integrally formed downwardly extending groove-engaging projections 47, 48, 49 and 50. Locating base 46 is rigidly (but adjustably) secured to the underside of frame base plate 60 by means of a pair of screws 160. Each screw 160 extends through a slot 162 formed in frame base plate 60 and screws into a threaded hole 164 in locating base 46. The four projections 47, 48, 49 and 50 are designated, are located and function as follows.

First forward projection 47 is aligned with and spaced from first rear projection 48 and they both engage the same groove, such as groove 26*a* in FIG. 4. Projections 47 and 48, which form a first pair of projections, are spaced apart from each other in the same direction as that in which device 10 moves, i.e., in the direction of arrow A in FIG. 2.

Second forward projection 49 is aligned with and spaced from second rear projection 50 and they both engage the same groove, such as groove 26*b* in FIG. 4. Projections 49 and 50, which form a second pair of projections, are spaced apart from each other in the same direction as that in which device 10 moves, i.e., in the direction of arrow A in FIG. 2.

The first pair of projections (47, 48) and the second pair of projections (49, 50) are spaced apart from each other in a direction which is transverse (i.e., perpendicular) to the aforesaid direction of arrow A and for a distance which is equal to the spacing between the parallel grooves 26*a* and 26*b*.

The use of a forward projection, such as 47 or 49, in conjunction with an aligned rear projection, such as 48 or 50, respectively, provides longitudinal stability and proper alignment of the components of device 10 as it is moved along the taping path. In other words, when the forward and rear projections in a pair are both bottomed out in the same groove, as shown in FIGS. 2 and 8, there is assurance that pressure roll 36 (and the tape therearound) is properly disposed and positioned with respect to the surface to which the tape is being applied and that device 10 is not abnormally tilted clockwise or counterclockwise from the position shown in FIGS. 2 or 8. This assumes, of course, that the length of the projections in the pair is selected to correspond to the known depth of the grooves being utilized.

The use of two laterally spaced apart pairs of projections offers further lateral stability because, when both pairs of projections are bottomed out in the two grooves, as shown in FIGS. 4 and 7, there is assurance that pressure roll 36 (and the tape therearound) is properly presented to the surface to which the tape is being applied.

It is to be noted that the prior art patents hereinbefore referred to, and especially U.S. Pat. No. 2,280,460, do not disclose such a construction or offer these aforesaid advantages as to alignment and stability.

Referring to FIG. 9, the guide adjustment means 52 enable the locating base 46 (and the four legs integrally formed thereon) to be adjustably shifted laterally relative to frame base plate 60. This ensures that the lateral edges 54 and 56 (FIG. 4) of the tape 12 will be properly positioned with respect to the surface to which the tape is to be applied. As will be understood, the means 34 for rotatably supporting the roll of tape 14 hold the roll in a precise location on the support frame 30 of device 10, as regards the lateral edges 54 and 56 of the tape. By moving or shifting locating base 46 laterally (i.e., transversely relative to the direction of arrow A) relative to frame base plate 60, the position of the tape edges will, therefore, be similarly shifted relative to the work surface.

As FIG. 9 shows, the guide adjustment means 52 comprise the screws 160 and the slots 162 in support frame base plate 60, hereinbefore described, and further comprise an additional pair of optionally usable threaded holes 165 for engaging the screws 160. Assuming that the screws 160 engage the holes 164, the slots 162 permit a certain amount of lateral positioning of locating base 46. If the screws 160 engage the other threaded holes 165, the slots 162 permit a further amount of lateral positioning of locating base 46.

As FIGS. 8 and 9 show, the guide adjustment means 52 further comprise a laterally extending elongated alignment slot 170 in locating base 46 near the rear end thereof which receives the lower ends of a pair of laterally spaced apart alignment pins 172 which are rigidly secured in holes 173 in support frame base plate 60.

The guide adjustment means 52 also comprises alignment index means in the form of a notch 174 in frame base plate 60 which exactly aligns and registers with a notch 176 formed in the edge of alignment slot 170 in locating base 46 to show a normal setting and which, when out of registry therewith, indicates by means of a graduated scale (not visible) on the underside of base 46, whatever new setting has been chosen.

OPERATION

In operation, as shown in FIGS. 4 and 8, device 10 is placed on surface 18 of the object 20 to be masked so that one pair of guide projections (47, 48) engages one of the grooves 26*a* and the other pair (49, 50) engages another parallel groove 26*b*. This ensures that pressure roll 36 and tape 12 therearound is properly positioned relative to the portion 16 of the surface to be masked and causes the adhesive side 12A of the tape beneath the pressure roll to adhesively engage the surface portion 16. The device 10 is then pulled by the user along the path in the direction of arrow A and tape 12 is stripped from the roll of tape 14 (which rotates) and is pressed against the portion 16 of the surface to be masked. When a desired length of tape 12 has been applied, as when the position shown in FIG. 2 is reached, the user stops moving device 10 along the path. Then, as shown in FIG. 3, the user rotates or tilts the device upwardly so that, first, both of the forward projections 47, 49 are lifted from the grooves and then, second, both of the rear projections 48, 50 are lifted from the grooves 26*a* and 26*b*. As this occurs, the blade guard plate 156, which has been engaging and tracking along the upper side of the tape 12 being applied, pivots out of the way (see FIG. 3) and allows the bottom rear corners 62A and 64A of the two frame side plates to engage the surface 18 and serve as pivot points enabling further tilting movement of the device 10 until the tape engages the tape cut-off blade 148. Then, the user pulls device 10 upward to cut the tape 12, whereupon the blade guard plate 156 is spring-biased back to its maximum protective position and device 10 is ready for the next taping operation. The spring-biased member 114 for holding the tape 12 against pressure roll 36 prevents tape backlash off of tape roll 14 as cutting occurs, but can be manually repositioned temporarily clear of the pressure roll to allow the user to provide a new roll of tape and reeve the tape around pressure roll 36 when the need arises.

As will be understood from the foregoing description, device 10 employs two pairs of projections on the guide member or locating base 46. However, it is within the scope of the invention to employ only one pair of projections, including a forward projection and a rear projection, if the portion of the surface to be taped comprises only a single groove. This construction would provide longitudinal stability, but lateral stability would then become the responsibility of the user and require the user to prevent sideways tilting of the device.

It is also to be understood that device 10 could be constructed so as to be movable along the desired path and tilted to cutting position by means of a robot, instead of a human operator. It is also contemplated that device 10 could be maintained stationary (but tiltable) and that the object to be taped, such as facia 20, could be moved along a path relative to device 10.

It is to be further understood that the locating base 46 and the projections 47, 48, 49 and 50 thereon are integrally formed of metal and that the tips of the projections are shaped and suitably smoothed so as not to cause damage to the grooves 26*a* and 26*b* in which they travel and so as to reduce friction therebetween. If desired, the tips of the projections may be coated with a layer of friction-reducing material (not shown), the composition of which depends on the composition of the material in which the grooves are formed.

In an actual embodiment of the invention, device 10 was configured and sized so as to be able to apply a strip of Tesa #7128 Fine Line masking tape on the order of 2.45 inches wide to a surface portion approximately 52 inches long. The pressure applying means in the form of pressure roller 36 wiped down the tape consistently with one pass of device 10 and caused it to adhere evenly to the surface to thereby prevent paint blow-by during spray-painting but still allow for the tape to be removed cleanly and evenly after spraying with no adhesive transfer, no paint edge build-up and no paint flaking.

We claim:

1. A device for dispensing and applying a strip of adhesive masking tape to a portion of a surface of an object which is to be painted, the surface portion to be masked including a convex curved section, said surface further including a groove lying adjacent and parallel to said surface portion to be masked and corresponding in curvature to said portion to be masked, said device being movable relative to said object along a path parallel to said groove and parallel to said portion to be masked, said device having a leading end which moves along said path toward said portion to be masked and having a trailing end which moves along said path away from a portion already masked, said device comprising:

a support frame;

means on said support frame for rotatably supporting a roll of adhesive masking tape;

pressure applying means on said support frame near said trailing end of said device around which tape from said roll of tape is reeved and having an undersurface which is adapted to press said tape against said surface portion to be masked;

cutting means on said support frame selectively operable to cut said tape;

and guide means on said support frame near said leading end of said device comprising two projections which are engageable with said groove and are spaced apart from each other in the same direction as said path, said projections having ends which lie in a plane which is spaced a fixed distance from another plane in which said undersurface of said pressure applying means lies.

2. A device according to claim 1 including guide adjustment means to enable said two projections to be adjustably moved relative to said support frame in a direction transverse to said path to thereby adjustably position said tow projections relative to a lateral edge of said tape.

3. A device according to claim 2 wherein said cutting means is disposed near said trailing end, and wherein said pressure applying means is disposed between said guide means and said cutting means.

4. A device according to claim 3 wherein said device further comprises means on said support frame for forcing said tape into engagement with said pressure applying means.

5. A device according to claim 1 or 2 or 3 or 4 wherein said device has a center of gravity which is located substantially above said pressure applying means.

6. A device for dispensing and applying a strip of adhesive masking tape to a portion of a surface of an object which is to be painted, the surface portion to be masked including a convex curved section, said surface further including a pair of grooves lying adjacent and parallel to said surface portion to be masked and corresponding in curvature to said portion to be masked, said device being movable relative to said object along a path parallel to said grooves and parallel to said portion to be masked, said device having a leading end which moves along said path toward said portion to be masked and having a trailing end which moves along said path away from a portion already masked, said device comprising:

a support frame;

means on said support frame for rotatably supporting a roll of adhesive masking tape;

pressure applying means on said support frame near said trailing end of said device around which tape from said roll of tape is reeved and having an undersurface which is adapted to press said tape against said surface portion to be masked;

cutting means on said support frame selectively operable to cut said tape;

and guide means on said support frame near said leading end of said device comprising two pairs of projections, one pair of projections comprising a first forward projection and a first rear projection, both first projections engageable with one groove of said pair of grooves, and the other pair of projections comprising a second forward projection and a second rear projection, both second projections engageable with the other groove of said pair of grooves, all said projections having ends which lie in a plane which is spaced a fixed distance from another plane in which said undersurface of said pressure applying means lies.

7. A device according to claim 6 including guide adjustment means to enable said two pairs of projections to be adjustably moved relative to said support frame in a direction transverse to said path to thereby adjustably position all said projections relative to a lateral edge of said tape.

8. A device according to claim 7 wherein said cutting means is provided with a movable blade guard and is disposed near said trailing end, and wherein said pressure applying means is disposed between said guide means and said cutting means.

9. A device according to claim 8 wherein said device further comprises means including a movable member on said support frame for forcing said tape into engagement with said pressure applying means and spring biasing means for moving said movable member against said tape.

10. A device according to claim 6 or 7 or 8 or 9 wherein said device has a center of gravity which is located substantially above said pressure applying means.

11. A device according to claim 6 wherein said guide means comprises a locator base in the form of a plate which is connected to said support frame and from which all said projections depend.

12. A device according to claim 11 wherein said plate of said locator base is curved convexly upwardly between the leading and trailing projections for obstruction clearance purposes.

13. A device according to claim 6 wherein said support frame comprises a pair of laterally spaced apart frame side plates having lower rear corners which serve as pivot points, wherein said pressure applying means projects below said frame side plates when both pairs of projections engage said grooves, and wherein said pivot points engage said surface of said object as said device is tilted and all said projections disengage from said grooves, thereby enabling said tape to be engaged and cut by said cutting means.

* * * * *